US012201150B2

(12) United States Patent
Wong

(10) Patent No.: US 12,201,150 B2
(45) Date of Patent: Jan. 21, 2025

(54) PREFORMED HERBAL CARTRIDGE

(71) Applicant: Shenzhen Jiapin Jianyi Technology Co., Ltd, Shenzhen (CN)

(72) Inventor: Charles Wong, Pasadena, CA (US)

( * ) Notice: Subject to any disclaimer, the term of this patent is extended or adjusted under 35 U.S.C. 154(b) by 519 days.

(21) Appl. No.: 17/581,795

(22) Filed: Jan. 21, 2022

(65) Prior Publication Data

US 2022/0151294 A1 May 19, 2022

Related U.S. Application Data

(63) Continuation-in-part of application No. 16/368,590, filed on Mar. 28, 2019, now abandoned.

(51) Int. Cl.
*A24F 40/42* (2020.01)
*A24F 40/20* (2020.01)
*A24F 40/70* (2020.01)

(52) U.S. Cl.
CPC ..... *A24F 40/42* (2020.01); *A24F 40/20* (2020.01); *A24F 40/70* (2020.01)

(58) Field of Classification Search
CPC ..... A24F 40/42; A24F 40/70
See application file for complete search history.

(56) References Cited

U.S. PATENT DOCUMENTS 2,992,648 A * 7/1961 Weiss ..... A24D 3/04 131/331
3,648,711 A * 3/1972 Berger ..... A24D 3/0283 131/210
2021/0259307 A1* 8/2021 Pijnenburg ..... A24F 40/485

* cited by examiner

*Primary Examiner* — Christopher M Rodd
*Assistant Examiner* — Jennifer A Kessie
(74) *Attorney, Agent, or Firm* — Clement Cheng

(57) ABSTRACT

A preformed cartridge includes a tube. The tube has a length and diameter. The length is greater than the diameter. A plant component is sized to fit within the tube. The plant component is formed from a hardened slurry. The plant component is securely lodged within the tube. The plant component is a plant slurry injected into the tube while wet or can be a plant slurry pre-hardened in a mold before mounting inside the herb tube. The plant component further includes a heater insertion opening and a flow channel. The heater insertion opening is in communication with a flow channel. The flow channel extends along the length of the tube, and the heater insertion opening is parallel to the flow channel.

9 Claims, 9 Drawing Sheets

PREFORMED HERBAL CARTRIDGE

This application is a continuation in part of and claims priority from U.S. patent application Ser. No. 16/368,590 by same inventor WANG, Shanghong entitled Preformed Herbal Cartridge filed Mar. 28, 2019, the disclosure of which is incorporated herein by reference.

FIELD OF THE INVENTION

The present invention is in the field of cartridges in particular to a preformed herbal cartridge and a preparation method thereof.

DISCUSSION OF RELATED ART

A variety of different preformed herbal cartridge products have been created for electronic use. At present, most of the common preformed herbal cartridges on the market are preformed herbal cartridge products in which herb sheets are rolled into strips with cartridge paper. The diameter of preformed herbal cartridges is relatively uniform. Most preformed herbal cartridges currently on the market are herb sheets are rolled into strips by cartridge paper, with the diameter relatively uniform. However, the production of preformed herbal cartridges traditionally used cigarette manufacturing equipment such as multi-component cigarette makers. At the same time, there is a problem that the cigarette paper is relatively soft, the support is poor, the herb is easily taken out from the other port of the nozzle, and the internal herb is unevenly distributed.

SUMMARY OF THE INVENTION

The object of the present invention is to provide a preformed herbal cartridge and a preparation method thereof, so as to solve the problem that the existing cigarette manufacturing methods is not good for preformed herbal cartridges. The herb is easily released from the other port of the nozzle, and the internal herb is unevenly distributed. To achieve the object, the present invention provides a preformed cartridge comprising a tube and a plant component assembly. The tube is used to preset the shape and size of the cartridges. After the components are uniformly mixed, the forming component is filled in the herb tube and the plant component in the herb tube is not easily detached. The plant component is combined with the herb tube to form a finished cartridge product.

The tube presets the diameter and length of the cartridge. The plant component is in the form of a herb slurry, and the plant component is poured into the herb pipe. The plant component is in the form of a herb slurry, and the plant component is introduced into a mold and molded into the herb pipe. A heating body insertion opening and an air flow channel are reserved in the herb pipe. The heating body insertion opening is for inserting a heating body into the herb pipe, and the air flow channel is used for airflow into and out of the herb pipe. The heating body insertion opening is in communication with the air flow channel or the hot body insertion opening and the air flow channel are disposed in parallel. The plant component is in the form of a sheet into which the plant component is encased. The plant component is in the form of a solid powder or granules sprayed onto the herb tube or filled in the herb tube. The tube can be sealed using a material such as a frangible sticker or other gas permeable structural member. A lining mesh is installed in the tube to prevent the plant component from being detached. Plant slurry is created by grinding or chopping herbs and mixing them with a liquid or gel binder such as glycerin.

The cartridge may also have a filter component or a perfuming component. The cooling assembly can be in the shape of a spiral. The outer wall of the tube can be printed with different colors or patterns. The herb ingredient component may include one or more of herb, flavor, herb extract, herb extract, cellulose, and other plant ground products or powders. A method of making preformed cartridges includes the steps of pre-forming a herb pipe. The herb tube is for presetting the shape and size of the cartridge. A plant component can be loaded into the herb tube. The plant component is uniformly mixed to form a component filled in the herb tube. The plant component in the herb tube is not easily detached. The plant component is combined with the herb tube to form a finished cartridge product.

The tube determines the diameter and length of the cartridge. Preferably, the plant component is made using an herb slurry that is poured or injected into the tube. Alternatively, the plant component is made using an herb slurry introduced into a mold which is then dried in the mold and then inserted into the herb tube. Thus, the herb slurry can be introduced into the tube before or after drying.

Preferably, a heater insertion opening and a flow channel are formed on the plant component. The heater insertion opening is preferably a cylindrical opening to receive a cylindrical heater needle. The heater needle heats to heat the plant component. The plant component can be formed of a rolled sheet and encased in the herb tube.

Optionally, the plant component also made as a solid powder or granules that is sprayed on the inner wall of the herb tube or filled in the herb tube. Alternatively, an end of the tube can be sealed using a material such as a frangible sticker or other gas permeable structural member. The frangible sticker can be a fragile sheet of adhesive paper in the shape of an endcap. Optionally, a lining mesh is installed in the tube to prevent the plant component from being detached.

A preformed cartridge includes a tube. The tube has a length and diameter. The length is greater than the diameter. A plant component is sized to fit within the tube. The plant component is formed from hardened slurry. The plant component is securely lodged within the tube. The plant component is a plant slurry injected into the tube while wet or can be a plant slurry pre-hardened in a mold before mounting inside the herb tube. The plant component further includes a heater insertion opening and a flow channel. The heater insertion opening is in communication with a flow channel. The flow channel extends along the length of the tube, and the heater insertion opening is parallel to the flow channel.

The plant component is formed from a sheet shape. The plant component is in the form of a solid powder or granules, and the plant component is formed by being sprayed onto an inside surface of the tube. The tube is sealed with a frangible cover. The lining mesh is mounted within the tube to prevent detachment of the herb component. The cartridge includes a cooling baffle, a filter assembly, or a perfuming component. The cooling assembly has a cooling baffle, and the cooling baffle includes an inside spiral and an outside spiral. The plant component includes ground herb, ground hemp, flavoring, herb extract, and cellulose.

A preformed cartridge has a tube. The tube is configured with a length and diameter. The length is greater than the diameter. A plant component is sized to fit within the tube. The plant component is formed from a hardened slurry, and the plant component is securely lodged within the tube. The plant component is a plant slurry injected into the tube while wet, or the plant component is a plant slurry pre-hardened in a mold before mounting inside the herb tube. The plant component further includes a heater insertion opening and a flow channel. The heater insertion opening is in communication with a flow channel. The flow channel extends along the length of the tube and the heater insertion opening is parallel to the flow channel. The cartridge includes a cooling baffle, a filter assembly, or a perfuming component.

A preformed cartridge can be made by the steps of: forming a cartridge tube with a predetermined diameter and length; and forming a plant component from a plant slurry. The plant slurry has a binder. The plant slurry is injected into the herb tube. The binder maintains the structural integrity of the plant component and binds the plant component to the herb tube. The plant component has a plant component upper end and a plant component lower end.

The next step is forming a heater insertion opening and a flow channel. Preferably there is a step of sealing the plant component lower end with a frangible cover. There can also be a step of installing a lining mesh to the plant component upper end.

A preformed herbal cartridge has an outer tube, wherein the outer tube is configured with an outer tube length and an outer tube diameter. The outer tube length is greater than the outer tube diameter. The outer tube has an outer tube inside surface extending between an outer tube lower end and an outer tube upper end. A plant component fits within the outer tube at the outer tube lower end. The plant component is securely lodged within the tube. The cooling baffle tube has a cooling baffle tube outside surface. The cooling baffle tube outside surface fits to the outer tube inside surface such that the outer tube inside surface is rolled around the cooling baffle tube outside surface.

A first cooling baffle opening and a second cooling baffle opening are defined within the cooling baffle tube and forming a pair of elongated channels through the cooling baffle, the first cooling channel and the second cooling channel are separated by the cooling baffle rib. A lining mesh is sandwiched between the baffle tube inside end and the plant component upper end. A frangible cover covers the outer tube lower end, and the frangible cover has a frangible cover rim that seals to the outer tube lower end.

The cooling baffle has an S-shaped profile being formed by a first fold, and a second fold, wherein the first fold and the second fold are both in the same orientation as both clockwise or both counterclockwise. The cooling baffle tube has a cooling baffle rib in the shape of an S. The cooling baffle rib is rolled from a strip of paper. The cooling baffle rib is rolled with a first inside layer defining the first cooling channel. A second inside layer defines the second cooling channel. The second inside layer continues around the second cooling channel to the first intermediate layer. The first inside layer wraps around the first cooling channel and continues to a second intermediate layer. The first intermediate layer continues wrapping around the first inside layer and continues to a second outside layer. The second intermediate layer wraps around the second inside layer which continues to a first outside layer. The second outside layer wraps around the second intermediate layer and terminates at a first baffle tube edge. The first outside layer wraps around the first intermediate layer and terminates at a second baffle tube edge.

The following call out list of elements can be a useful guide for in referencing the element numbers of the drawings.

11 Outer Tube
12 Plant Component
13 Heater Insertion Opening
14 Flow Channel
15 Cooling Baffle
16 Perfuming Component
17 Lining Mesh
18 Frangible Cover
21 Heater Insert Opening Beveled Surface
22 Flow Channel Edge Wall
23 Flow Channel Connection
24 Flow Channel Right Sidewall
25 Flow Channel Left Sidewall
26 Flow Channel Corner
27 Point Component Inside Corner
31 Cooling Baffle Outside Edge
32 Cooling Baffle Opening
33 Outside Spiral
34 Inside Spiral
35 Spiral Struts
36 Plant Component Lower End
37 Plant Component Upper End
38 Airstream
39 Baffle Tube inside End
41 First Fold
42 Second Fold
43 Third Fold
44 Perfuming Component Lower Edge
45 Lining Mesh Opening
46 Frangible Cover Flap
47 Outer Tube Lower End
48 Outer Tube Upper End
49 Frangible Cover Rim
50 Heating Needle
51 Heating Needle Tip
52 Heating Needle Shaft
53 Heating Needle Base
54 First Cooling Baffle Opening
55 Second Cooling Baffle Opening
56 Cooling Baffle Tube
57 Cooling Baffle Tube Outside Surface
58 Outer Tube Inside Surface
59 S Shaped Profile

60 Electronic Controlled Vaporizer
62 Cover
63 Cover Opening
64 External Portion
65 Internal Portion
66 Base
71 Cooling Baffle Rib
72 First Inside Layer
73 Second Inside Layer
74 First Intermediate Layer
75 Second Intermediate Layer
76 First Outside Layer
77 Second Outside Layer
78 First Baffle Tube Edge
79 Second Baffle Tube Edge
S1 First Step
S2 Second Step
S3 Third Step

DETAILED DESCRIPTION OF THE PREFERRED EMBODIMENT

The present invention provides a preformed herbal cartridge having a formed outer tube 11 and a plant component 12. The outer tube 11 is preferably a rolled multiple ply paper tube that defines the outer shape and size of the preformed herbal cartridge. The paper can be card paper or hemp paper and rolled to a light cardboard consistency and thickness. The plant component 12 is uniformly mixed and with interference fit can be packed into the herb tube so that it is not easily detached, while maintaining a loose enough packing to allow airflow through the plant material of the plant component 12. The plant component 12 is combined with the herb tube to form a finished one time use cartridge product that can be inserted into a heater appliance for electrical resistance heating of the plant material. The plant component is more uniformly mixed with voids between the plant material also being uniformly mixed. The distribution in the herb tube when uniform reduces detachment risk so that the manufacturing process is no longer limited by the cost and space of large-scale specialized equipment. The present invention allows manufacturing of preformed cartridges of different shapes and sizes, and can be applied to the production of multiple varieties in small batches, or to large quantity production runs.

Figure 1:
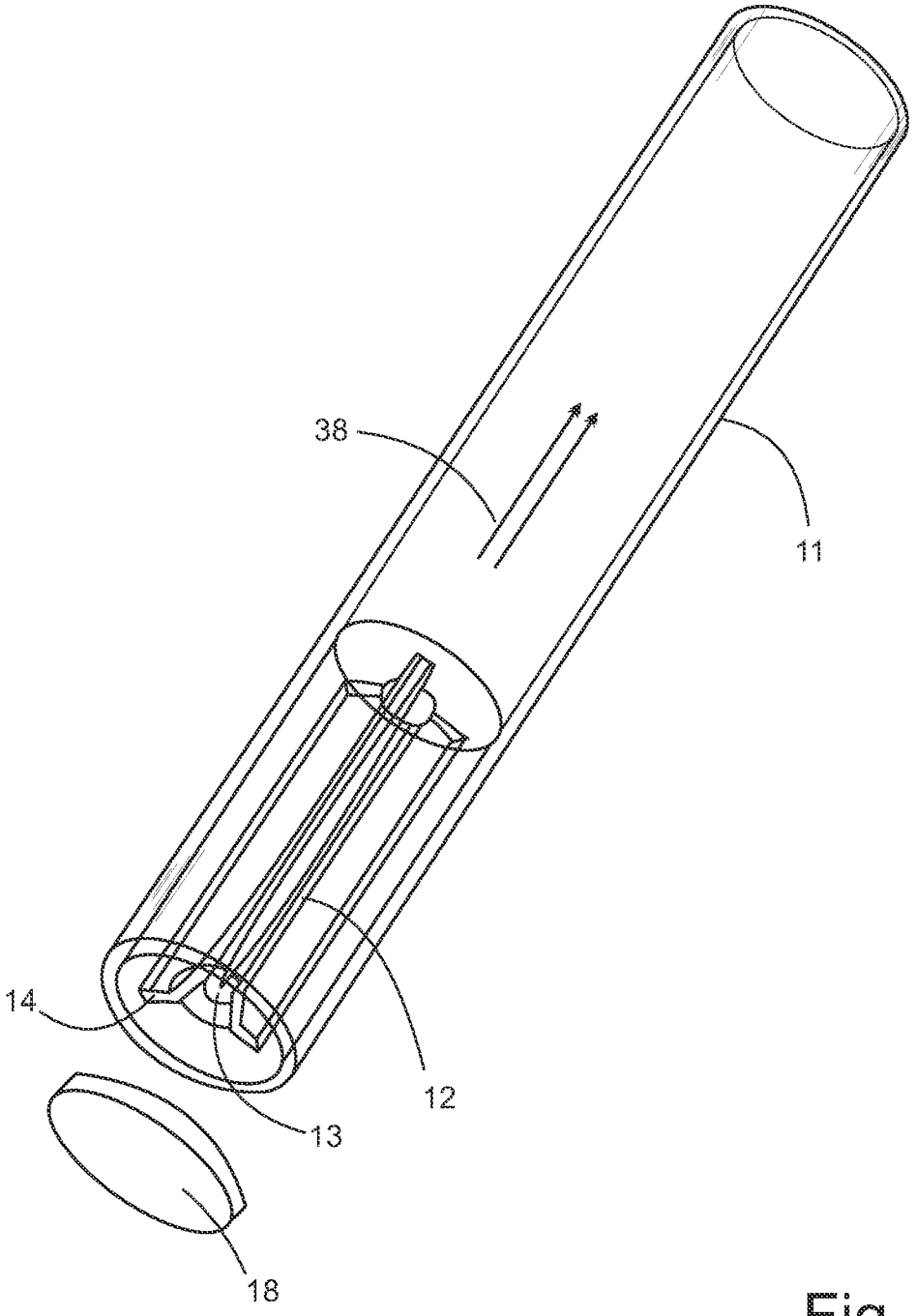
FIG. 1 is a schematic structural view of a preformed cartridge branch according to an embodiment of the present invention.

FIG. 1 shows a schematic view of a pre-formed cartridge according to an embodiment of the present invention. The preformed cartridge includes: a formed outer tube 11 and a plant component 12 having a heater insert opening 13 receiving a heating needle, and a flow channel 14 that provides for initial airflow. The airflow 38 is traveling upward from the plant component to the top end of the other tube 11. The herb tube 11 is used to preset the shape and size of the preformed cartridge. The plant component 12 is evenly distributed in the outer tube 11 and the herb at the inner wall of the outer tube 11. The component assembly 12 is in close contact with the inner wall of the pipe, and the plant component 12 is combined with the outer tube 11 to form a finished cartridge. Preferably, the shape of the herb tube 11 is cylindrical, but is not limited to this shape. The outer tube 11 defines the diameter and length of the preformed cartridge. The diameters and lengths of the outer tube 11 in a batch or lot can all be different, with some longer or shorter, and some with greater or smaller diameter. The outer tube 11 is preferably a rolled paper tube.

Uniformity of the herb tube 11 is not required in this production method because the slurry can be injected into a variety of different tube sizes. The slurry can be formed by finely chopping plant material and mixing the plant material with a binder. Thus, the diameter and length of the tube 11 can be arbitrary, which is mainly determined according to actual needs. Preferably, the diameter of the herb tube 11 may range from 5.8 mm to 7.9 mm. For example, the diameter of the herb tube may be 5.8 mm, 7.2 mm, 7.7 mm, 7.8 mm or 7.9 mm. Preferably, the length of the herb tube may range from 40 mm to 80 mm; for example, the diameter of the herb tube may be 45 mm, 50 mm or 60 mm. Preferably, the length of the herb tube is between 30 mm to 80 mm. Different colors or patterns may be printed on the outer wall of the herb tube 11 to diversify the appearance of the cartridge so that the cartridges have different physical dimension as well as different outward appearance to make it look like all of the cartridges are unique and custom hand made.

The plant component 12 may include one or more of herb, hemp, flavor, herb extract, herb extract, cellulose, and other plant ground powders. A binder can be introduced with the slurry to keep the plant component 12 in cohesive physical structure. The plant component 12 receives a frangible cover 18. The binder forms a flow channel 14 with a heater insert opening 13 so that a heating needle passing through the frangible cover 18 can heat the plant component 12.

The preformed cartridge can be used in low temperature non-combustion electronic cartridges, which is in the form of an herb slurry. Further, a method of loading the plant component 12 in the form of an herb slurry into the herb tube includes, but is not limited to, merely injecting the herb slurry directly into the herb tube or introducing the plant component into a mold. After molding, it is loaded into the herb pipe. Specifically, if the herb slurry is directly poured into the herb pipe, since the herb slurry is wet before pouring, and the herb tube is dry, the herb slurry is poured into the herb tube to be combined with the two, and a quick drying is required. The herb tube and the plant component form a finished cartridge product to prevent liquid of the herb slurry from penetrating the herb tube and affecting the appearance of the product. For example, the plant component in the tube can be dried by air drying or baking so that the plant component will adhere to the tube during the drying process. The plant component can include a herb slurry that can be molded before being loaded into the tube 11. After the herb slurry is introduced into the mold, it is dried, and then the dried plant component is put into the herb pipe. The plant component can then be adhered to the tube 11 with a food grade adhesive.

Figure 2:
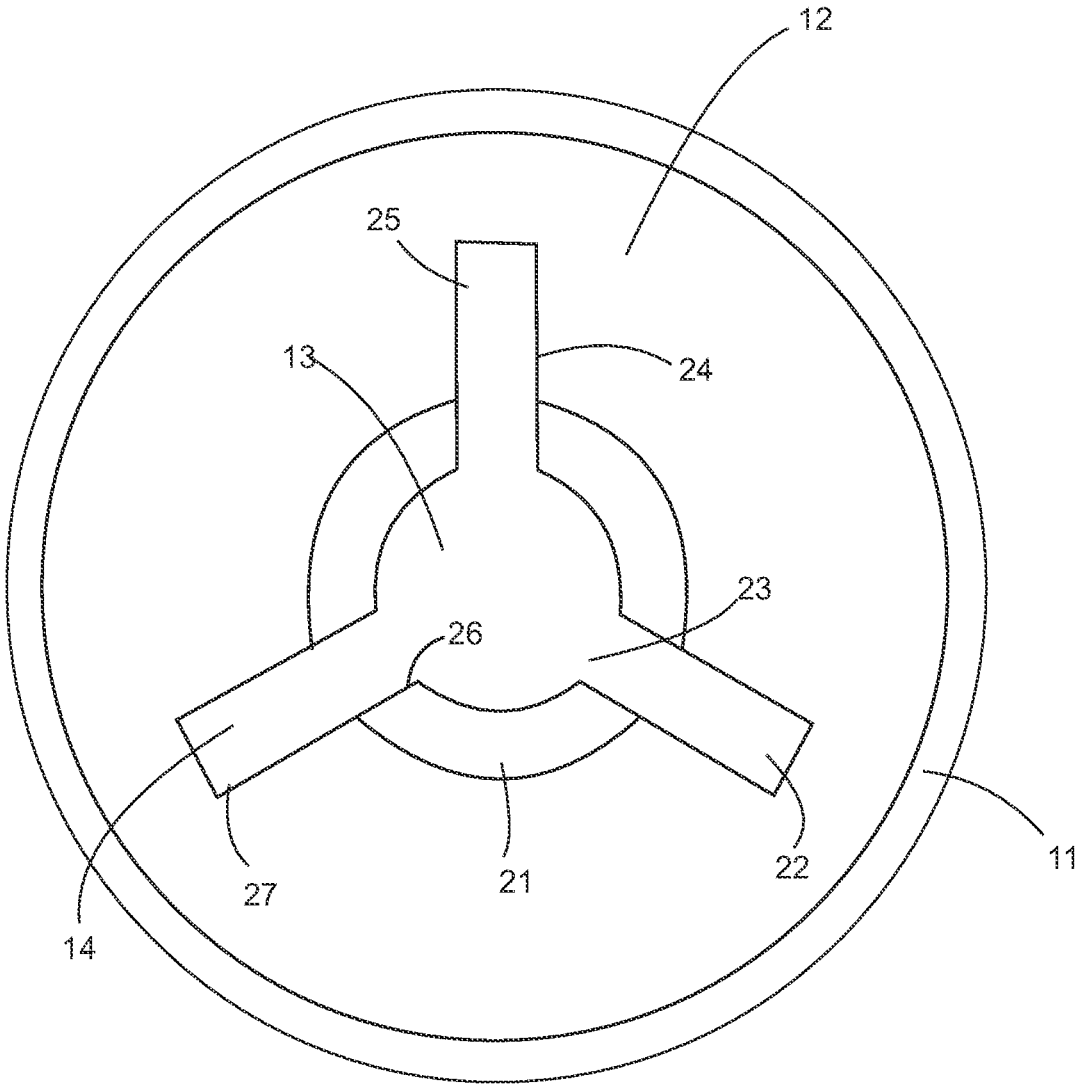
FIG. 2 is a schematic structural view of a preformed cartridge branch with a heating body insertion opening and an air flow passage according to an embodiment of the present invention.

As seen in FIG. 2, a heating body insertion opening 13 and a gas flow channel 14 for inserting a heating body into the herb tube 11 are also formed as hollows within the plant component 12. The air flow passage 14 is for the ingress and egress of airflow in the plant component 12 during combustion. Specifically, the cartridge is required to be heated to transpire the smoke, and the heating body insertion opening 13 is used to adapt the heating element in the smoking article, and the air flow passage 14 is to provide airflow and oxygen. Further, depending on the shape of the heating body, the shape of the inserted heating body insertion opening 13 may be different, and may be a circular shape, or a long strip shape or the like. Similarly, the air flow passage 14 may have a herringbone shape, a cross shape, or a star shape. The heating body insertion opening may be in communication with the air flow channel or the heating body insertion opening may be provided with a spacer layer in the middle of the air flow channel, and the two are disposed in parallel. The plant component poured into the herb tube is tightly combined with the herb pipe, and is dried to form a cartridge. Since the cartridge can be directly ignited for smoking in the field of cartridges, it is preferable not to omit the heating body insertion opening so as to provide improved airflow and combustion.

The plant component can be formed as a solid powder or granules that are sprayed onto or filled within the tube 11. Specifically, the plant component 12 can be sprayed onto the inner wall of the herb tube 11, and the plant component 12 can be adhered to the inner wall of the herb tube. Thereafter, the herb tube 11 and the plant component 12 are dried to form a finished cartridge product.

The heater insertion opening 13 is preferably cylindrically formed by a cylindrical rod shaped mold that extends into the plant component 12 when the plant component 12 is in wet slurry form. The flow channel 14 is formed to connect to the heater insertion opening 13 also when the plant component 12 is in wet slurry form. The flow channel 14 may be formed as three vanes, each including a flow channel edge wall 22 generally parallel to an external surface of the tube 11. Each vane shaped flow channel 14 extends radially from the heater insertion opening 13 and connects at a flow channel connection 23. The flow channel connection 23 may have a flow channel corner 26 formed at an interface between the heater insert opening 13 and the flow channel 14. The flow channel edge wall 22 may form a plant component inside corner 27 with either a flow channel right side wall 24 or a flow channel left sidewall 25. The flow channel right sidewall 24 is preferably parallel to the flow channel left sidewall 25. The heater insert opening 13 may include a heater insert opening beveled surface 24 that circumscribes the heater insert opening 13. The plant component 12 can thus be consumed beginning from the hollow portion formed by the flow channels 14.

Figure 3:
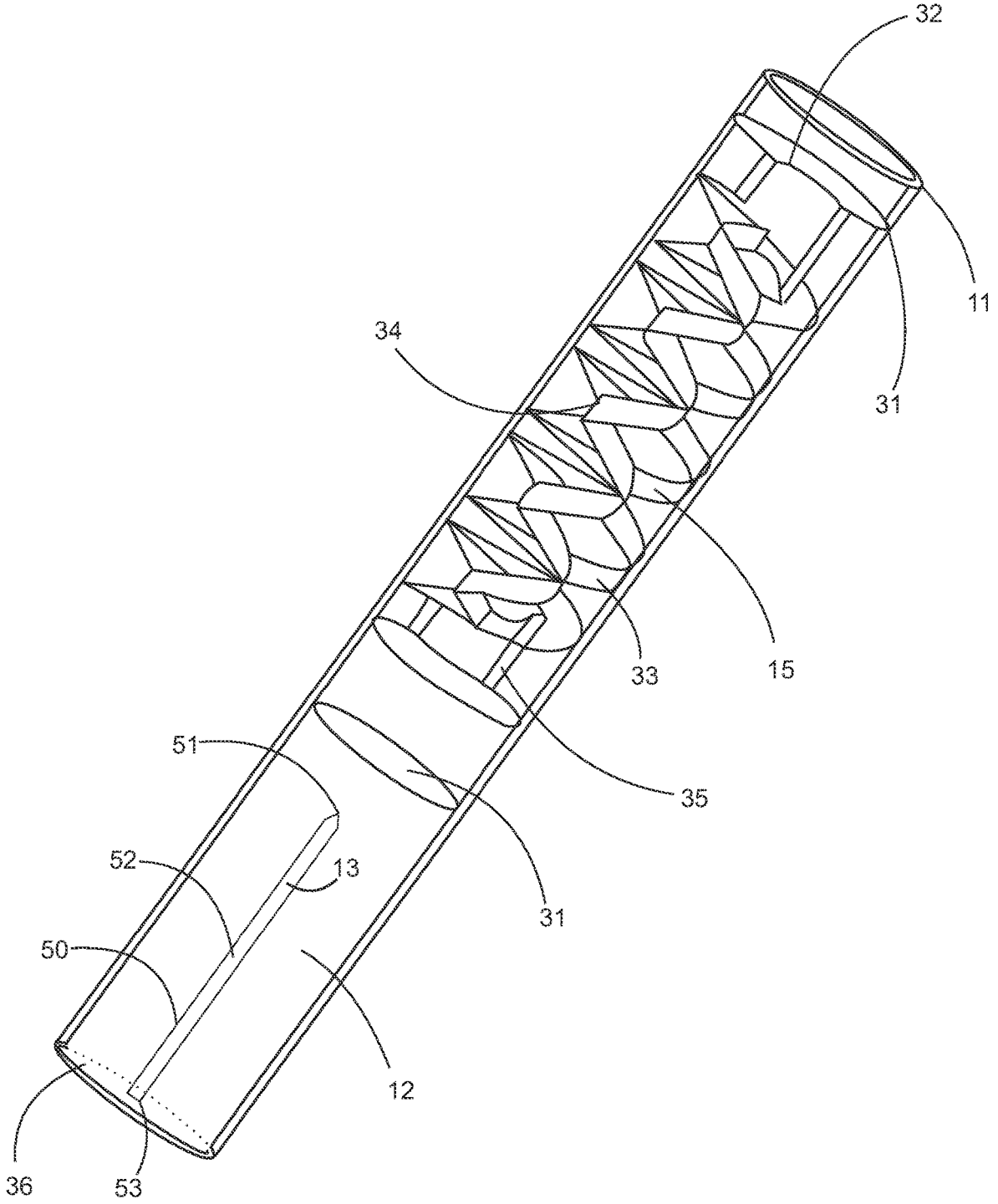
FIG. 3 is a schematic structural view of a prefabricated cartridge branch provided with a cooling assembly according to an embodiment of the present invention.

As seen in FIG. 3, the cooling baffle 15 may include a cooling baffle outside edge 31 that engages in inside surface of the tube 11. The cooling baffle 15 has a cooling baffle opening 32 so as to allow airflow through the cooling baffle. A plurality of spiral baffles can comprise the cooling baffle including an inside spiral 34 and an outside spiral 33. The inside spiral 34 can be connected to the outside spiral 33 at spiral struts 35. The spiral struts 35 can be vertically formed to connect the components of the cooling baffle. The cooling baffle 15 can be formed as a plastic injection molded member and may have an opening for receiving the perfuming component 16.

The plant component 12 generally has a plant component upper end 37 that may have a lining mesh 17, and the plant component 12 may also have a plant component lower end 36 that receives a frangible cover 18. The lining mesh 17 can be formed as a filter assembly for filtering the airstream stream of smoke.

A heating needle 50 having a heating needle tip 51 at the tip of a heating needle shaft 52 extends upwardly from the heating needle base 53. The heating needle 50 is inserted into the plant component 12 through the frangible cover and forming a seal with the frangible cover 18. The heater insertion opening 13 can be formed as a long hollow that receives an insertion of the heating needle 50. The plant component lower end receives the heating needle 50. The heating needle 50 has a heating needle shaft 52 that extends at least more than halfway through the plant component 12. The heating needle tip 51 punctures the frangible cover 18. The cartridge is separately constructed from the heating needle 50. The heating needle 50 can heat the next cartridge after the first cartridge is consumed.

Figure 4:
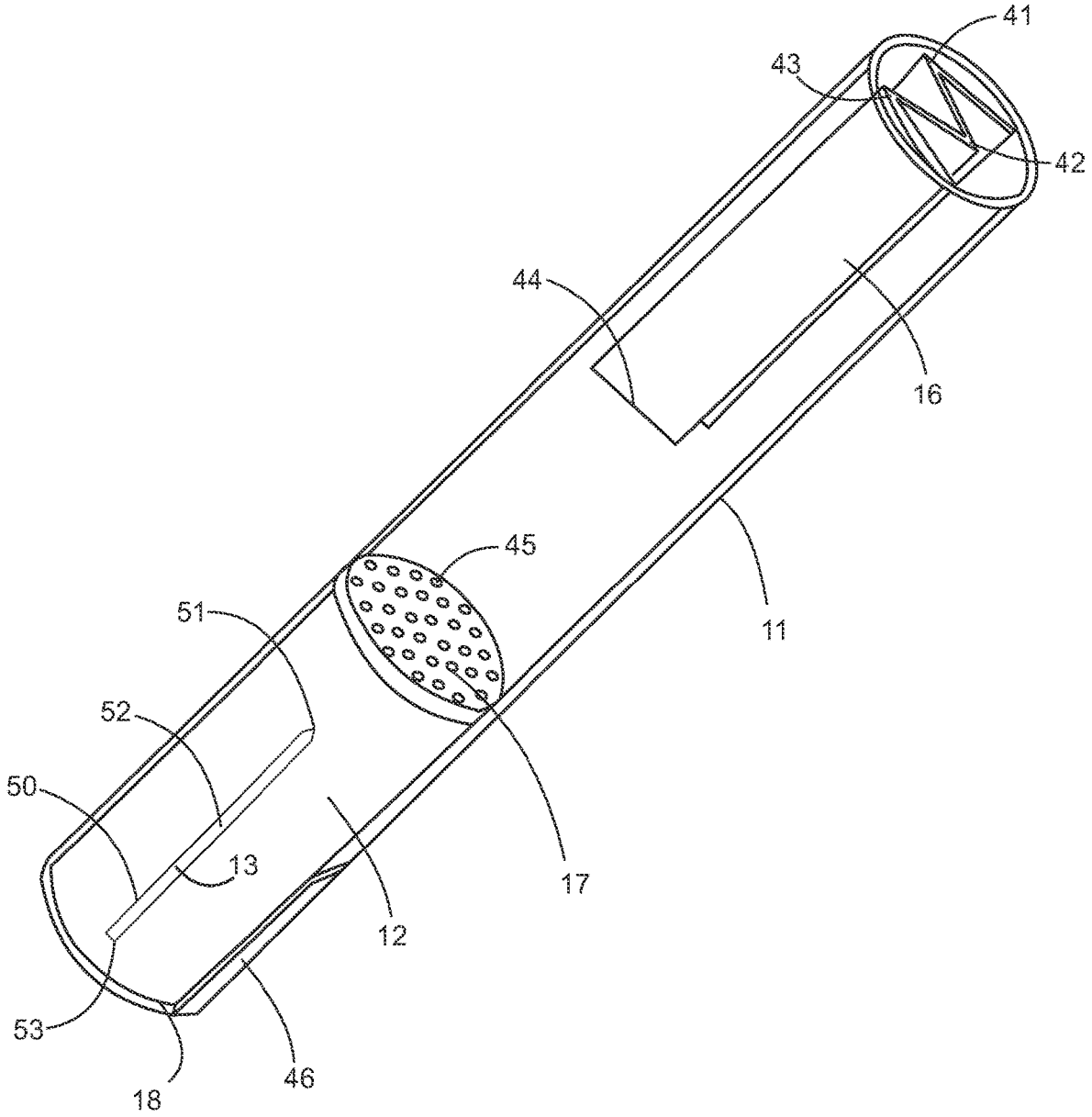
FIG. 4 is a schematic structural view of the preformed cartridge support provided with a frangible sticker, a lining mesh, and a perfuming assembly according to an embodiment of the present invention.

As seen in FIG. 4, the plant component 12 has solid powder or granules of a certain gas permeability, and may be a fluffy structure at an interface where the tube 11 and the plant component 12 are combined. The frangible cover 18 can be formed as a fragile sticker and can be pasted to the plant component lower end 36. The seal of the fragile sticker 18 is preferably, moisture resistant with sufficient structural integrity to retain particles of the plant component 12 from dislodging before use. When used, the smoking device can pierce the fragile sticker. The fragile sticker may include a frangible cover flap 46 that extends along a length of the tube 11.

The inner lining mesh 17 can be a porous material with gas permeability, structural support, and high temperature resistance to prevent the detachment of solid particles without affecting the gas permeability of the cartridge. The lining mesh 17 can be a fabric or sponge for example, including lining mesh openings 45. The lining mesh 17 can be a metal porous or perforated screen mesh such as a metal sponge cut to a circular disk shape. The lining mesh openings 45 need not be in a regular pattern. If the lining mesh 17 is made of metal and has structural stability, the frangible cover 18 can be attached to the outer tube 11, then the plant component 12 packed against the frangible cover 18, then the plant component slightly compressed by being sandwiched between the lining mesh 17 and the frangible cover flap 46. The manufacturing can be completed in two steps, with the outer tube and frangible cover formed in a first step, then in a second step a packing machine loads the plant component, loads a lining mesh over the plant component and then loads a cooling baffle tube over the lining mesh. The lining mesh 17 preferably has a balanced porosity relative to the plant component 12 so that airflow passing through the plant component lower end 36 through the plant component upper end 37 receives a filter process before entering the cooling baffle tube 56.

The scented component 16 is optionally installed, and the scented component 6 can be a folded scented paper for enhancing the aroma of the smoke and enriching the body and flavor of the smoke. The folded paper can have the shape of an M including a first fold 41, a sevenfold 42, and a third fold 43. The perfume in component lower edge 44 can abut the lining mesh opening 45, or be separated by a gap from the lining mesh opening 45.

A perfume component 16 can be inserted into the tube 11. The perfume component can be made of card stock with an exposed surface area for transferring scent such as from essential oils, nape oils and the like to the airstream 38. The perfume component 16 can act as a filter if made from porous material and disposed in the herb pipe. As seen in FIG. 3, the shape of the cooling assembly can be a spiral. During smoking the extracted flue gas is relatively hot and the cooling component can be used to cool the flue gas before inhalation. The spiral cooling component can increase the flue gas flow distance for better cooling. The filter assembly may be a sponge type porous filter to filter harmful substances such as tar. The perfume component can be a folded flavored paper. The flavored paper can be used to enhance the aroma of the smoke and enrich the body and aroma of the smoke.

Figure 5:
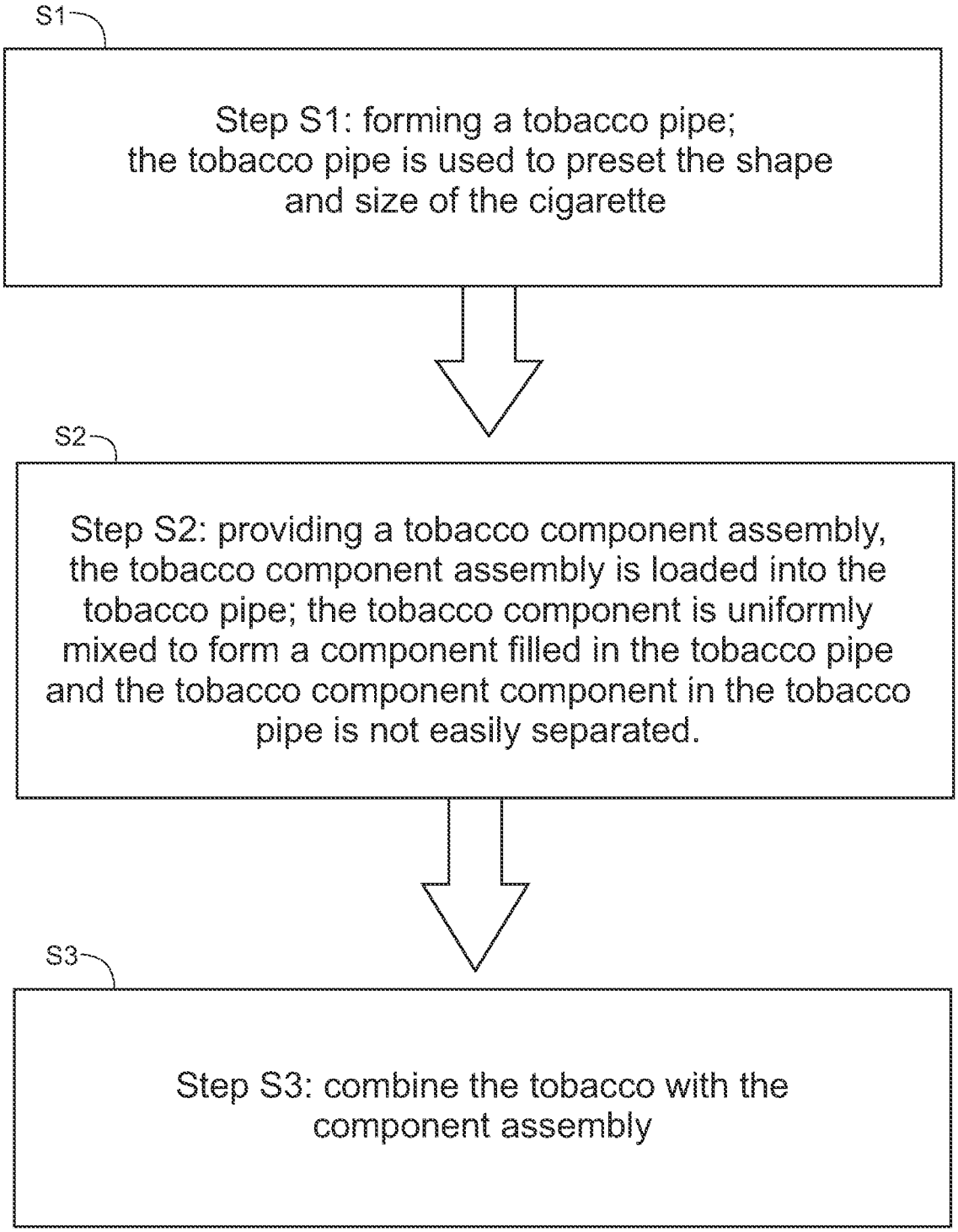
FIG. 5 is a schematic flow chart of a method for preparing the preformed cartridge branch according to an embodiment of the present invention.

The method of making present invention includes three main steps as seen in FIG. 5:

Step S1: forming a herb tube or pipe; the herb tube is used to preset the shape and size of the cartridge;

Step S2: providing a plant component, the plant component is loaded into the herb pipe; the plant component is uniformly mixed to form a component filled in the herb tube and the plant component in the herb tube is not easily separated; and Step S3: combining the plant component with the herb tube to form a finished cartridge product.

The first step includes defining the size of the cartridge by selecting the tube which includes defining a diameter and a length of the cartridge. Preferably, an herb ingredient component can be made into an herb slurry, and the herb ingredient component can be loaded into the herb tube. The plant slurry can be made using a binder and plant component such as herb to make a herb slurry.

The second step is loading the plant component into the tube which can be by injection, or by mold forming and insertion. The plant component can be formed as a solid powder or granule, sprayed or filled in the herb tube, so that the tube and the plant component are bonded together. Finishing steps may include external appearance, insertion of the filter or cooling baffle and external cosmetic ornamentation.

The key feature of the present invention is to use herb slurry with preformed air passages. Also, the plant component upper end 37 having a lining mesh 17 with small lining mesh openings 45 is an improvement for retaining the plant component 12. Also, the M shaped folded paper perfume component 16 provides an additional filtering and material retention capability.

The M shape is preferably formed as a pleat, and can be pleated with small additional folds to add additional surface area along its length. When pleated with additional folds, the overall shape can still be an M shape.

Figure 6:
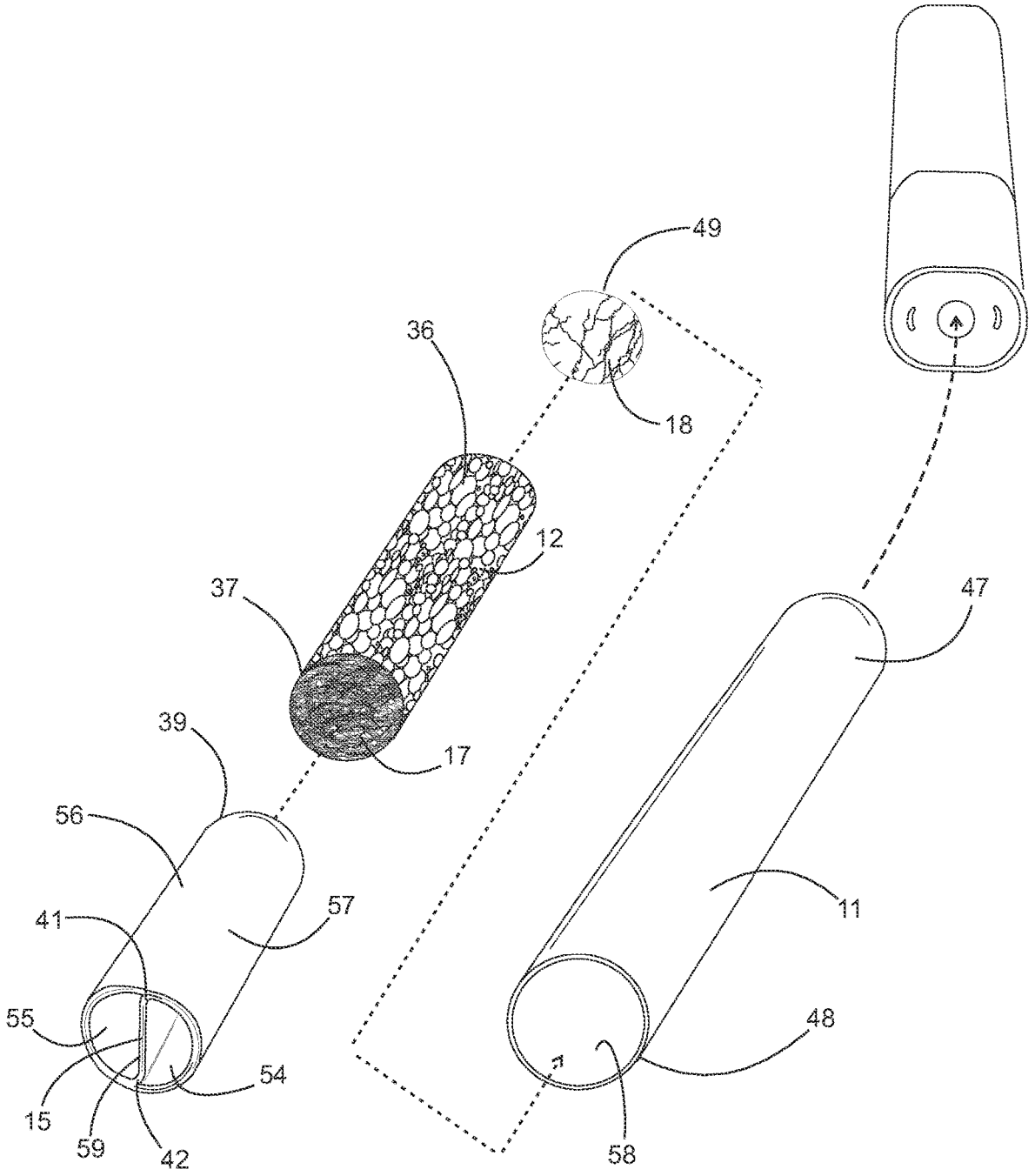
FIG. 6 is an exploded view of the present invention showing assembly of the preformed herbal cartridge.
Figure 7:
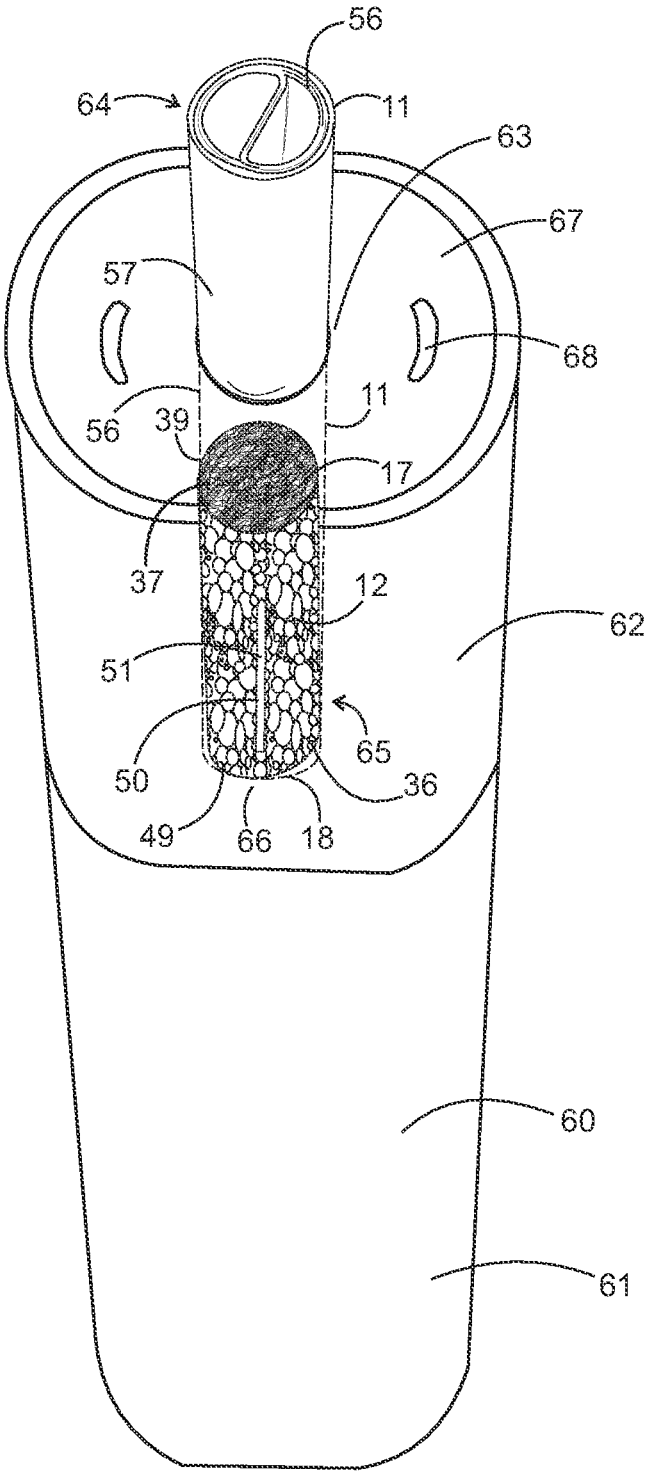
FIG. 7 is a diagram showing insertion of the preformed herbal cartridge into an electronic controlled vaporizer.

As seen in FIGS. 6-7, the outer tube 11 has an outer tube lower end 47 and an outer tube upper end 48. The outer tube 11 also has an outer tube inside surface 58. The outer tube inside surface 58 is rolled around the cooling baffle tube outside surface 57. The cooling baffle tube outside surface 57 of the cooling baffle tube 56 is slightly less than the outer tube inside surface 58. The first cooling baffle opening 54 and the second cooling baffle opening 55 are defined within the cooling baffle tube 56 and form channels along the cooling baffle 15. The cooling baffle 15 has an S-shaped profile 59 being formed by a first fold 41, and a second fold 42.

The baffle tube inside end 39 abuts the lining mesh 17 which in turn abuts the plant component upper end 37 such that the lining mesh 17 is sandwiched between the baffle tube inside end 39, and the plant component upper end 37. The plant component lower end 36 is preferably near or flush with the outer tube lower end 47. The frangible cover rim 49 of the frangible cover 18 covers the outer tube lower end 47. The frangible cover rim 49 can be crimped and glued to the outer tube lower end 47.

Figure 8:
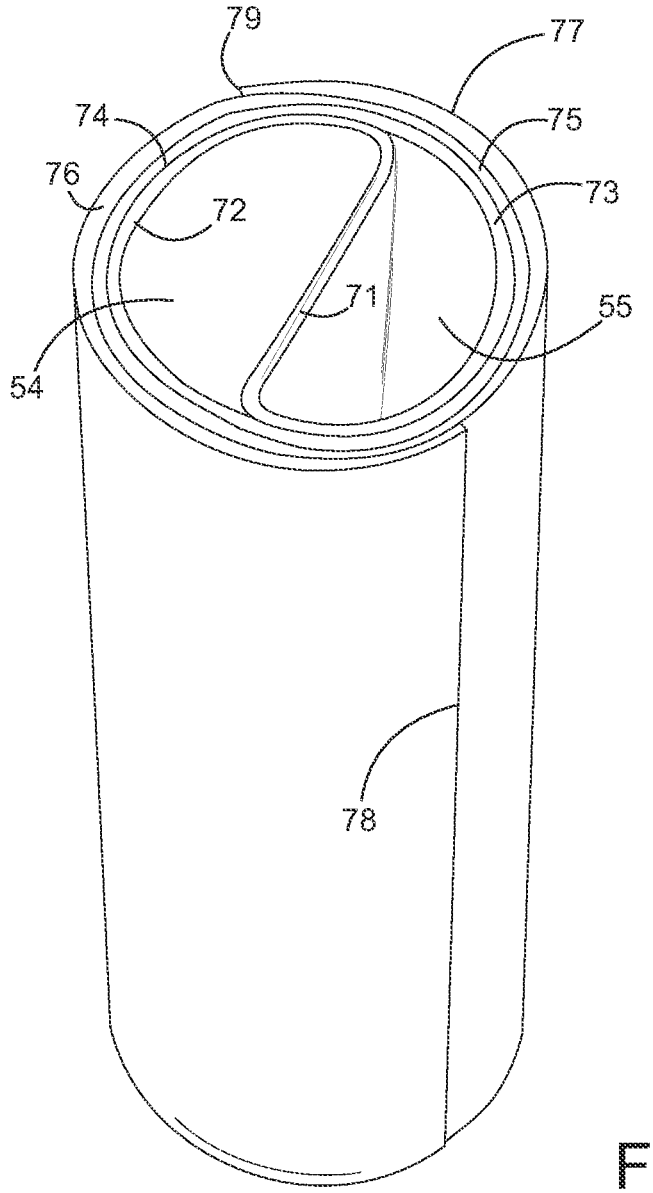
FIG. 8 is a diagram showing the cooling baffle tube.
Figure 9:
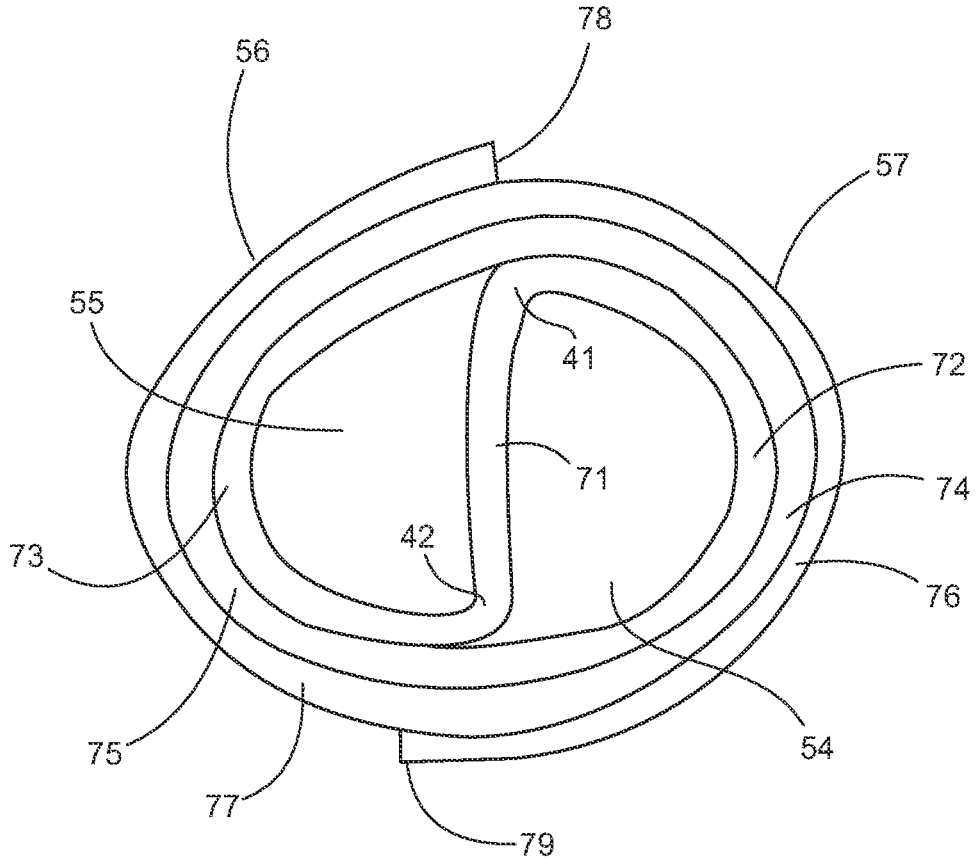
FIG. 9 is a diagram showing a cross-section of the cooling baffle tube.

As seen in FIGS. 8-9, the cooling baffle tube 56 has a cooling baffle rib 71 in the shape of an S. The cooling baffle rib 71 bisects the cooling baffle tube 56 and is elongated. The cooling baffle rib 71 separates the cooling baffle tube 56 into a first cooling baffle opening 54 and a second cooling baffle opening 55. The first cooling baffle opening 54 provides a channel for hot air to pass through, mix and cool. The second cooling baffle opening 55 also provides a channel for hot air to pass through, mix and cool. The first cooling channel and the second cooling channel are separated by the cooling baffle rib 71.

The cooling baffle rib 71 is rolled from preferably a single strip of paper. The cooling baffle rib 71 is rolled with a first inside layer 72 defining the first cooling baffle opening 54 which is the first cooling channel, and with a second inside layer 73 defining the second cooling baffle opening 55 which is the second cooling channel. The second inside layer 73 continues around the second cooling baffle opening 55 to the first intermediate layer 74. Similarly, the first inside layer 72 wraps around the first cooling baffle opening 54 and continues to a second intermediate layer 75. The first intermediate layer 74 continues wrapping around the first inside layer 72 and continues to a second outside layer 77. The second intermediate layer 75 wraps around the second inside layer 73 which continues to the first outside layer 76. The second outside layer 77 wraps around the second intermediate layer 75 and terminates at the first baffle tube edge 78. The first outside layer 76 wraps around the first intermediate layer 74 and terminates at a second baffle tube edge 79.

The invention claimed is:

1. A preformed herbal cartridge comprising:

an outer tube, wherein the outer tube is configured with an outer tube length and an outer tube diameter, wherein the outer tube length is greater than the outer tube diameter, wherein the outer tube has an outer tube inside surface extending between an outer tube lower end and an outer tube upper end;

a plant component fit within the outer tube at the outer tube lower end, wherein the plant component is securely lodged within the tube;

a cooling baffle tube, wherein the cooling baffle tube has a cooling baffle tube outside surface, wherein the cooling baffle tube outside surface fits to the outer tube inside surface such that the outer tube inside surface is rolled around the cooling baffle tube outside surface;

a first cooling baffle opening and a second cooling baffle opening defined within the cooling baffle tube and forming a pair of elongated channels through the cooling baffle tube, the first cooling channel and the second cooling channel are separated by a cooling baffle rib;

a lining mesh, wherein the lining mesh is sandwiched between the baffle tube inside end and the plant component upper end; and a frangible cover covers the outer tube lower end, and the frangible cover has a frangible cover rim that seals to the outer tube lower end, wherein the cooling baffle tube has a cooling baffle rib in the shape of an S, wherein the cooling baffle rib is rolled from a strip of paper, wherein the cooling baffle rib is rolled with a first inside layer defining the first cooling channel, and with a second inside layer defining the second cooling channel, wherein the second inside layer continues around the second cooling channel to the first intermediate layer, wherein the first inside layer wraps around the first cooling channel and continues to a second intermediate layer, wherein the first intermediate layer continues wrapping around the first inside layer and continues to a second outside layer, wherein the second intermediate layer wraps around the second inside layer which continues to a first outside layer, wherein the second outside layer wraps around the second intermediate layer and terminates at a first baffle tube edge, wherein the first outside layer wraps around the first intermediate layer and terminates at a second baffle tube edge.

2. The preformed cartridge of claim 1, wherein the plant component is a plant slurry pre-hardened in a mold before mounting inside the herb tube.

3. The preformed cartridge of claim 1, wherein the plant component is formed from a sheet shape.

4. The preformed cartridge of claim 1, wherein the plant component is in the form of a solid powder or granules, and wherein the plant component is formed by being sprayed onto an inside surface of the tube.

5. The preformed cartridge of claim 1, wherein the plant component includes ground herb, ground hemp, flavoring, herb extract, and cellulose.

6. The preformed cartridge of claim 1, wherein the plant component is a plant slurry injected into the tube while wet, wherein the plant component is formed from a hardened slurry.

7. The preformed cartridge of claim 1, wherein the plant component further includes a heater insertion opening and a flow channel, wherein the heater insertion opening is in communication with a flow channel, wherein the flow channel extends along the length of the tube, and wherein the heater insertion opening is parallel to the flow channel.

8. The preformed cartridge of claim 1, wherein the tube is sealed with a frangible cover, wherein the plant component lower end is flush with the outer tube lower end, wherein the frangible cover rim is crimped and glued to the outer tube lower end.

9. The preformed cartridge of claim 1, wherein the cooling baffle has an S-shaped profile being formed by a first fold, and a second fold, wherein the first fold and the second fold are both in the same orientation as both clockwise or both counterclockwise.

* * * * *